United States Patent [19]

Jett et al.

[11] 4,056,145

[45] Nov. 1, 1977

[54] HYDRAULIC HOLDDOWN FOR WELL PACKER STINGER

[75] Inventors: Marion Barney Jett; Dennis Mitchel Spriggs, both of Dallas, Tex.

[73] Assignee: Dresser Industries, Inc., Dallas, Tex.

[21] Appl. No.: 626,415

[22] Filed: Oct. 28, 1975

[51] Int. Cl.[2] ..... E21B 23/00; E21B 33/122

[52] U.S. Cl. ..... 166/212; 166/189; 285/306

[58] Field of Search ..... 166/125, 212, 207, 120, 166/313, 189, 88, 89; 285/106, 96, 306

[56] References Cited

U.S. PATENT DOCUMENTS

| | | | |
|---|---|---|---|
| 2,880,805 | 4/1959 | Nelson et al. | 166/212 |
| 3,229,997 | 1/1966 | Simpson et al. | 166/125 |
| 3,252,516 | 4/1966 | Leutwyler | 166/189 |
| 3,497,001 | 2/1970 | Brown | 166/212 |

*Primary Examiner*—James A. Leppink
*Attorney, Agent, or Firm*—Michael J. Caddell

[57] ABSTRACT

Hydraulic locking means is provided in a dual stinger latching mechanism which hydraulic locking means secures tubular conduit within the packer latching mechanism against pressure below the packer tending to pump the conduit out. The hydraulic locking means utilizes the pressure below the packer to activate a gripping means on the conduit which is subject to the upward pressure force.

5 Claims, 7 Drawing Figures

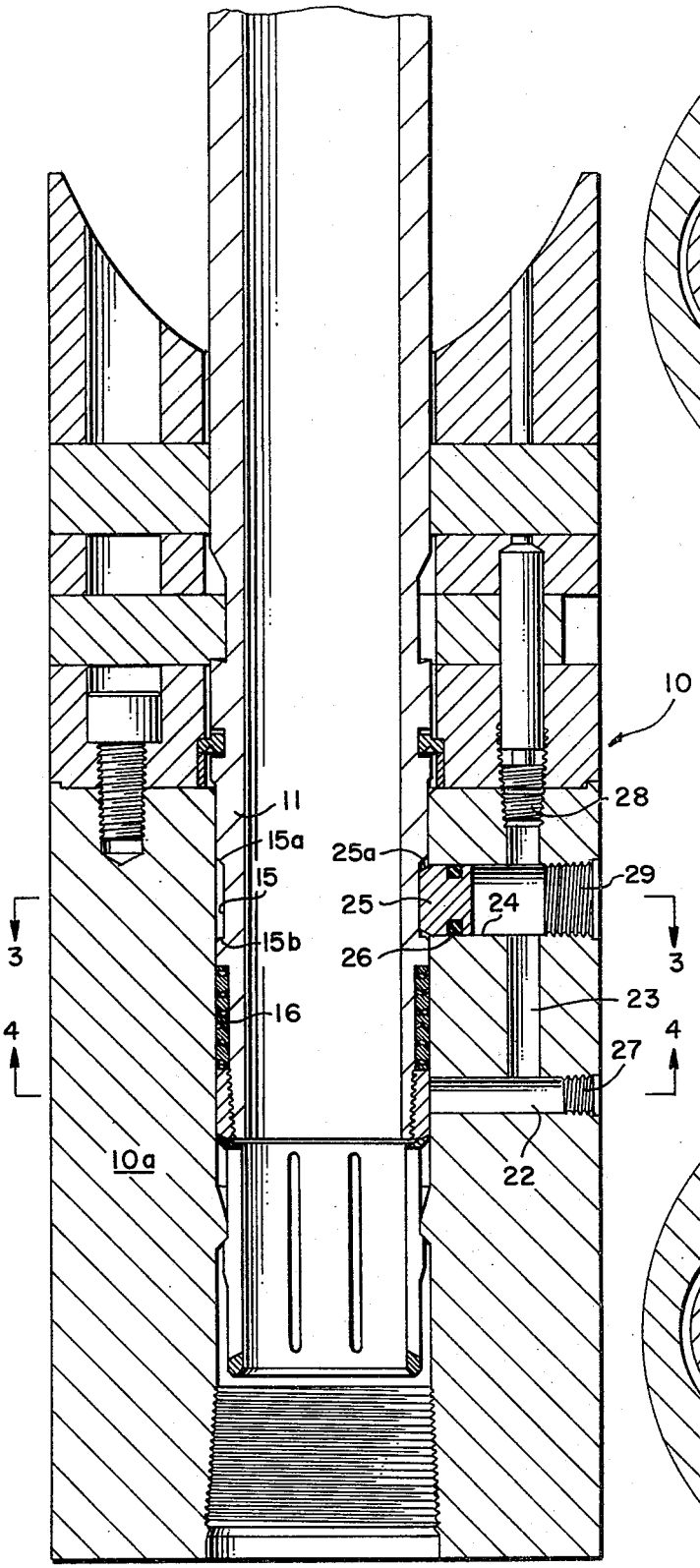
FIG. 2
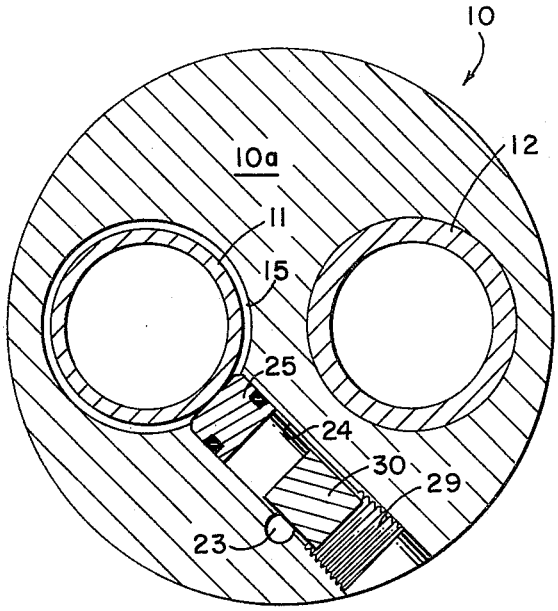
FIG. 3
FIG. 4
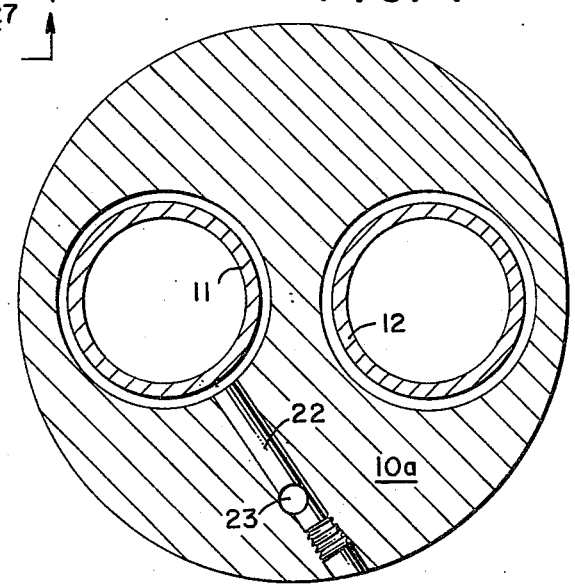

HYDRAULIC HOLDDOWN FOR WELL PACKER STINGER

BACKGROUND OF THE INVENTION

The present invention is related to hydraulic conduit locking means in multi-string well packers and more specifically involves a pressure actuated gripping means within a multi-string well packer which provides a retention force for the upward conduit string in the packer. The present invention is paticularly advantageous for use in the stinger relatch means disclosed in U.S. Pat. No. 3,229,997 issued Jan. 18, 1966 to H. E. Simpson et al. and said patent is hereby incorporated by reference in this application.

Prior devices which have been provided to secure the conduit within the multiple string packer have utilized collet and locking sleeve screw thread arrangements, snap action collets, and J-slot arrangements. The difficulties with these devices are that the threaded arrangement and the J-slot arrangements require some manipulation of the tubing for release. The snap collet usually does not provide sufficient retention force and the pressure actuated collet is often difficult or impossible to release after having been locked on for an extended period of time.

The present invention solves these problems by providing an uncomplicated, reliable, hydraulically actuated locking means for securing conduit within the multiple string packer

BRIEF DESCRIPTION OF THE DRAWINGS

FIG. 2 is an elevational, cross-sectional view of the dual string packer of FIG. 1 taken at an angle of 90° thereto;

FIG. 3 is an axial cross-sectional view of the packer of FIG. 1 taken at line 3—3 therein;

FIG. 4 is an axial cross-sectional view of the packer of FIG. 1 taken at line 4—4;

DESCRIPTION OF THE PREFERRED EMBODIMENTS

Figure 1:
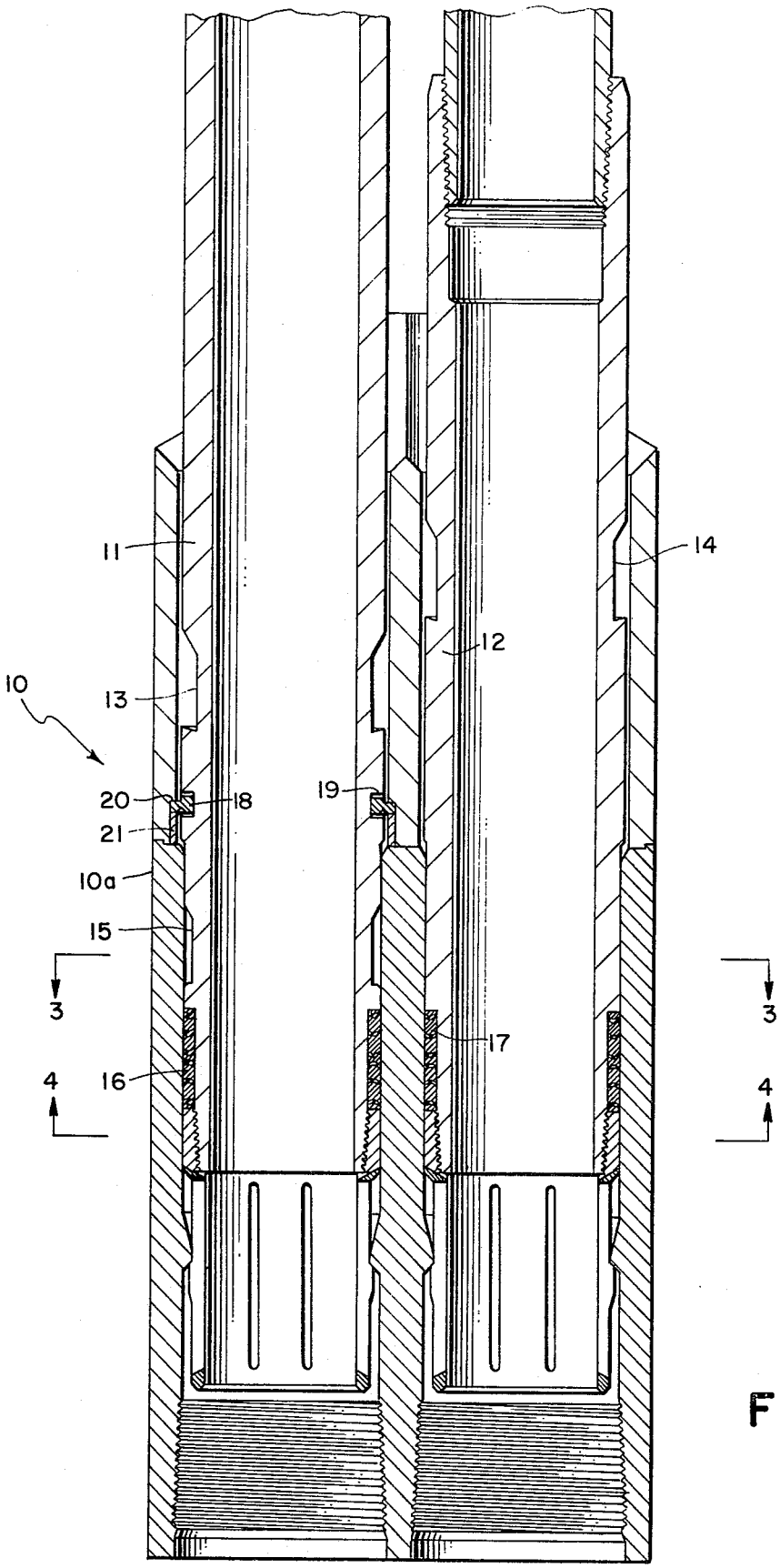
FIG. 1 is an elevational, cross-sectional view of the latching mechanism of a dual string packer.

In FIG. 1, a dual string well packer latching mechanism 10 is disclosed similar to the latching mechanism disclosed in the aforementioned incorporated U.S. Patent. The latch mechanism 10 utilizes a generally cylindrical body member 10*a* in which are telescopically located a primary relatch stinger mandrel 11 and a secondary relatch stinger mandrel 12 both of which comprise generally cylindrical tubular members.

The stinger mandrels 11 and 12 are provided with cam latch grooves 13 and 14 therein for engagement by the latch means as described in the aforementioned incorporated patent. Briefly, the latch means provides a positive locking action on one of the mandrels when the other mandrel is withdrawn from the packer but upon reinsertion of the second mandrel, the positive latch on the mandrel in place is deactivated allowing either mandrel to be selectively removed from the packer as desired.

Primary mandrel 11 is also provided with a locking channel 15 formed in the external wall thereof and passing peripherally around the mandrel. Circumferential seal means 16 and 17 encircle the primary and secondary mandrels and provide sealing, slidable engagement with the inner bores of the latch body 10*a*.

A shearable ring 18 is provided in encircling engagement about the primary mandrel and fits into a ring recess 19 in the primary mandrel and further projects outward to engage a downwardly projecting shoulder 20 of latch body 10*a* and is held in abutment therewith by a shearing retainer sleeve 21.

Referring now to FIG. 2, a side elevational, cross-sectional view of the latch mechanism 10 is disclosed which view is a 90° rotation of the view of FIG. 1. FIG. 2 shows the latch body 10*a* containing the primary relatch stinger mandrel 11 having the lock channel 15 formed in the outer wall thereof. The latch body 10*a* has a transverse lower passage 22 formed therein which communicates with a vertical passage 23 which in turn, fluidically communicates with a pressure cylinder bore 24.

A pressure responsive sliding piston member 25 is sealably located within bore 24 and is arranged to move radially inward towards primary mandrel 11 into locking engagement in channel 15. The outer peripheral edge 25*a* along the front surface of piston member 25 is bevelled at a preset angle and the upper and lower walls 15*a* and 15*b* of channel 15 are also sloped at an angle. Piston member 25 is provided with a circular seal 26 for sealing, slidable engagement with cylinder wall 24.

Passage 22 passes through latch body 10*a* below seals 16 and communicates fluidically with pressure below the packer. Passages 22, 23 and 24 are sealed at one end by threaded plugs 27, 28 and 29.

Referring to FIG. 3, a cross-sectional axial view of the invention is illustrated locking upward from the bottom of the packer and taken at line 3—3 of FIG. 1. In FIG. 3 primary mandrel 11 and secondary mandrel 12 are shown in axial view and the piston member 25 is illustrated in the engaged position in lock channel 15. A spacer 30 is provided in bore 24 to insure proper operation of piston 25.

FIG. 4 illustrates an axial cross-sectional view of the mechanism 10 locking upward from the lower end of the packer at line 4—4 of FIGS. 1 and 2. FIG. 4 more clearly illustrates bore passages 22 and 23.

Figure 5:
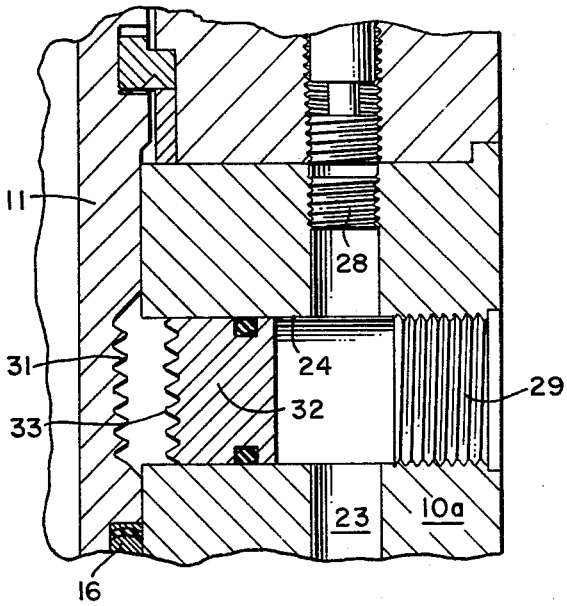
FIG. 5 is a partial cross-sectional view of the packer of FIG. 2 showing an alternate embodiment of the invention.

FIG. 5 illustrates a partial cross-sectional view of an alternate embodiment for the locking piston assembly of FIGS. 1 through 4. In FIG. 5, the primary mandrel 11 is shown having a peripheral toothed section 31 arranged to coincide with cylinder bore 24 of latch body 10*a*. A toothed sliding piston member 32 is provided in bore 24 having a complementary toothed face 33 adapted for substantial engagement with the toothed section 31 of mandrel 11. The toothed sections 31 and 33 are arranged such that the angles of the abutting tooth faces between the two members allow the piston member 32 to be wedged back into cylinder bore 24 upon the application of a predetermined amount of upward force on primary mandrel 11.

Likewise, the bevelled shoulder and bevelled walls of piston 25 and channel 15 are selected so as to provide a wedging action of piston 25 back into bore 24 upon a predetermined application of upward force on primary mandrel 11.

Figure 6:
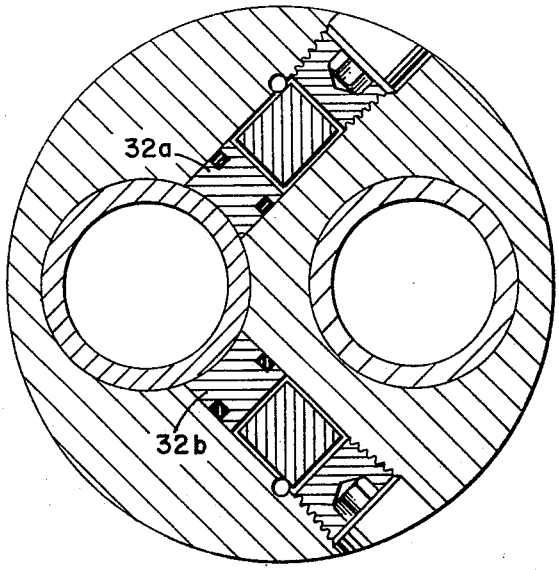
FIG. 6 illustrates an alternate embodiment to that of FIG. 3.
Figure 7:
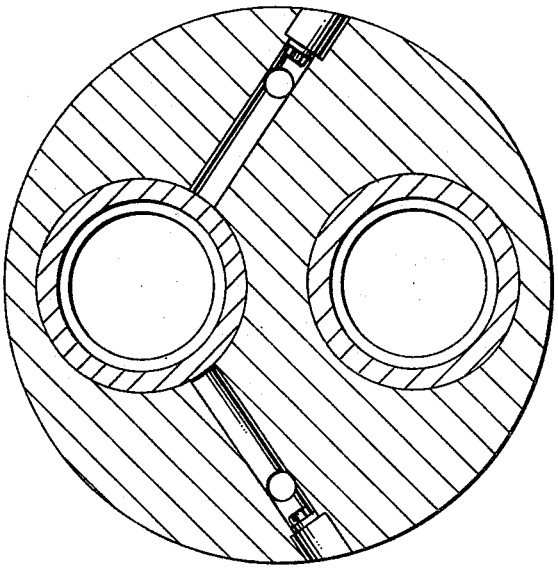
FIG. 7 illustrates the corresponding axial view to FIG. 4 of the embodiment of FIG. 6.

FIGS. 6 and 7 disclose another embodiment of the invention of FIG. 5 utilizing the toothed perimeter on the primary mandrel with a plurality of complementary toothed piston members 32*a* and 32*b* located in a plurality of cylinder bores within the latch body 10*a*. This embodiment is intended to provide even greater reliability through the use of multiple locking members on the primary mandrel.

In typical operation, the packer mechanism attached to latch assembly 10 is lowered into the well bore while attached to the primary mandrel 11. Premature release of the packer from the mandrel 11 is prevented by shear ring 18. After the packer is in place in the well bore, the secondary tubing string containing the secondary relatch stinger mandrel 12 may be lowered into the well bore to engage in mechanism 10. Upon this engagement, the latch cams of mechanism 10 will be released from the primary and secondary bores. At this point in time, with the packer set, the formation pressure below the packer may have a tendency to float the tubing string containing the mandrels out of the latch mechanism 10. This tendency is overcome in the primary string through the action of the locking piston 25.

Fluidic pressure from below the packer communicates upward from below seals 16 into passage 22, through passage 23, into bore 24, to react against piston 25. The pressure moves piston 25 into locking engagement in bore 15 thereby preventing pump-out of the mandrel 11 from the packer. The degree of slope on wall 15*b* and the bevel 25*a* of piston 25 are selected so that the mandrel 11 may be withdrawn from the latch mechanism 10 by pulling upward on the primary string. Preferably, the resultant locking force of piston 25 arising from the action of fluid pressure thereon is equal to or slightly greater than the upward buoyant force on the primary mandrel from the formation pressure. This may be arrived at through proper selection of piston areas 25 and slope angles 25*a* and 15*b*.

The operation of the alternate embodiment of FIGS. 5, 6 and 7 is similar in that fluid pressure from below the packer serves to move the toothed piston into abutting engagement with the toothed portion of the primary mandrel, thereby applying a restraining force on the mandrel equal to or greater than the upward buoyant force caused by the fluid pressure. Once again the angles of the toothed mating portions are selected so that the restraining force is in the preferable and desired range.

Although certain preferred embodiments of the present invention have been herein described in order to provide an understanding of the general principles of the invention, it will be appreciated that various changes and innovations can be effected in the described latching mechanism without departing from these principles. All modifications and changes of this type are deemed to be embraced by the spirit and scope of the invention except as the same may be necessarily limited by the appended claims or reasonable equivalents thereof.

The embodiments of the invention in which an exclusive property or privilege is claimed are defined as follows:

1. A relatch stinger mechanism for multi-string well packers, comprising:

body means having bore passage means therethrough adapted to receive a plurality of conduit strings telescopically therein;

latch means in said body means for securing the remainder of the conduit strings in said body means when one conduit string is removed therefrom; and, hydraulic lock means in said body means communicating with pressure acting below the well packer and adapted to be engaged in response to said pressure into restraining abutment with a conduit string in said bore passage means.

2. The relatch stinger mechanism of claim 1 wherein said lock means comprises lateral sliding lock member means telescopically located in sealing slidable engagement in said body means and arranged for radial projecting into abutment with a conduit string in said bore passage.

3. The relatch stinger of claim 2 wherein said lock member means comprises a hydraulically actuated piston member having angled abutment surface means thereon adapted for wedging abutment with an angled surface on a conduit string in said bore passage means.

4. The relatch stinger of claim 3 wherein said surface means are angled to provide a restraining force against a conduit string in said bore passage means equal to or greater than the hydraulic buoyance of the conduit string.

5. The relatch stinger of claim 4 wherein said surface means comprises a plurality of transverse teeth across the abutment end of said piston member.

* * * * *